United States Patent [19]

Albrecht

[11] 4,240,131

[45] Dec. 16, 1980

[54] SEALED LIGHTING ELEMENT ASSEMBLY

[75] Inventor: Donald E. Albrecht, Woodbury, Minn.

[73] Assignee: Minnesota Mining and Manufacturing Company, St. Paul, Minn.

[21] Appl. No.: 20,315

[22] Filed: Mar. 14, 1979

[51] Int. Cl.[3] ..... F21V 29/00

[52] U.S. Cl. ..... 362/267; 362/61; 525/526

[58] Field of Search ..... 362/61, 80, 83, 158, 362/263, 267; 260/836, 33.6 EP; 525/526

[56] References Cited

U.S. PATENT DOCUMENTS

| | | | |
|---|---|---|---|
| 3,725,698 | 4/1973 | Craig | 362/267 |
| 3,784,807 | 1/1974 | Boekkooi | 362/267 |

FOREIGN PATENT DOCUMENTS

| | | | |
|---|---|---|---|
| 2733599 | 7/1977 | Fed. Rep. of Germany | 362/267 |
| 53-132188 | 11/1978 | Japan | 525/526 |
| 1491539 | 11/1977 | United Kingdom | 260/836 |

*Primary Examiner*—Donald P. Walsh

*Attorney, Agent, or Firm*—Cruzan Alexander; Donald M. Sell; Dean P. Edmundson

[57] ABSTRACT

A sealed or bonded assembly for lighting elements (such as an automobile headlamp) comprising a housing and a cover therefor. The housing and cover have portions (preferably along their respective peripheries) which cooperate to form a seal when a photocurable sealant is disposed therebetween and cured. A preferred photocurable sealant is an epoxy-containing composition, especially one which has been flexibilized by the incorporation of vinyl-terminated acrylonitrile-butadiene polymer.

18 Claims, 7 Drawing Figures

SEALED LIGHTING ELEMENT ASSEMBLY

BACKGROUND OF THE INVENTION

This invention relates to sealed or bonded assemblies for lighting elements and to a novel method for producing same. In another aspect, sealed beam lamps and a method for producing same are described. In yet another aspect, an actinic light curable composition is utilized to seal a light transmissive lens cover to a concave, relfective housing to provide a lighting element.

For many years, the United States Department of Transportation has required the use of sealed beam headlamp assemblies on automobiles sold in the U.S. These assemblies generally comprise a substantially concave (preferably parabolic) lighting element housing and a visible light transmissive cover therefor, this cover often being referred to as a lens. The housing usually has a concave reflective surface and supports the lighting element so as to outwardly direct the light thereby generated through the lens.

The conventional technique employed to seal a cover (e.g. a lens) to a housing involves the application of heat to the respective peripheries thereof to fuse or weld the lens to the housing, the lighting element being interiorly disposed therein. This conventional technique has a tendency to develop internal strain in either the lens or the housing (occasionally resulting in breakage of the assembly). The problem of breakage has recently become of particular concern due to the now fashionable rectangular headlamps employed in the automobile industry. Breakage in the range of 10% to 20% has been reported for rectangular housing assemblies which are particularly susceptible to generation of unequal internal stress during the joining of the housing and its cover by the use of heat.

One possible solution to the aforementioned heat fusing breakage problem has been to utilize conventional heat-cured epoxy-containing materials to join the perimeters of the housing and the lens. While the temperature at which heat-cured epoxy resins may be cured is considerably lower than the temperature required to heat fuse the cover and lighting element housing, heating the assemblies long enough to bring about epoxy cure is costly.

SUMMARY OF THE INVENTION

The present invention provides a sealed assembly for a lighting element which overcomes the problems associated with conventional sealing methods which require the application of heat. The method of the present invention has the additional advantage of having the potential to provide lighting element assemblies where the housing or its cover, or both, are comprised of heat sensitive polymeric materials such as polymethylmethacrylate and polycarbonate.

In one aspect, the present invention provides a method for sealing a lighting element comprising the steps of:

a. providing a housing and a cover therefor, at least a portion of said housing or said cover being light transmissive, said housing or said cover being adapted to support a lighting element within said enclosure so that said element may be electrically energized, said housing and said cover having cooperating portions which are adapted to be joined with a actinic light curable adhesive;

b. placing on one or both said cooperating portions a quantity of actinic light curable adhesive sufficient to form a seal between said housing and said cover when said sealant is cured;

c. bonding said cover to said housing at said cooperating portions by curing said adhesive therebetween with actinic light.

In a preferred practice of the present invention an actinic light curable epoxy-containing composition is employed to seal the housing to its cover. In the most preferred practice of this invention, an actinic light curable epoxy-containing composition having improved flexibility by the incorporation therein of vinyl-terminated acrylonityrile-butadiene polymer is utilized to provide the sealed enclosure. This composition is the subject of applicant's copending application Ser. No. 20,312 entitled "Photocurable Epoxy Composition Having Improved Flexibility", and incorporated by reference herein.

The sealed enclosure for a lighting element produced in the practice of the present invention comprises a housing and a cover therefor. At least a portion of the housing or the cover must be visible light transmissive (to permit light egress from said lighting element) and either the housing or the cover must be adapted to support a lighting element within the enclosure, preferably so that said lighting element may be exteriorly energized, such as by means of leads passing through said housing to a source of electricity. Further, the housing and the cover have cooperating portions (usually on their respective peripheries) which are adapted to be joined with an actinic light curable adhesive. Disposed between the cooperating portions of the housing and the cover is a photocured composition which is preferably derived from an actinic light curable epoxy-containing composition, especially one which also includes therein vinyl-terminated acrylonitrile butadiene polymer.

The present invention contemplates the joining or sealing of all manner of housings and covers therefor which cooperate to provide a lighting element enclosure. The sealed assembly or enclosure may be adapted to receive a lighting element (i.e. the assembly may have replaceable lighting elements) or the enclosure may already have the lighting element supported or mounted within. Optionally associated with the assemblies of the invention is a reflector means. In a preferred practice of the invention a concave, interiorly reflective housing (including therein a lighting element) is joined to a generally flat transparent cover or lens so as to provide a hermetic lighting element enclosure. The cover may, of course, have a curved surface or body if desired.

BRIEF DESCRIPTION OF THE DRAWINGS

The present invention is described in greater detail hereinafter with reference to the accompanying drawings wherein like reference characters refer to the same elements in the several views and in which.

DETAILED DESCRIPTION OF THE INVENTION

Figure 1:
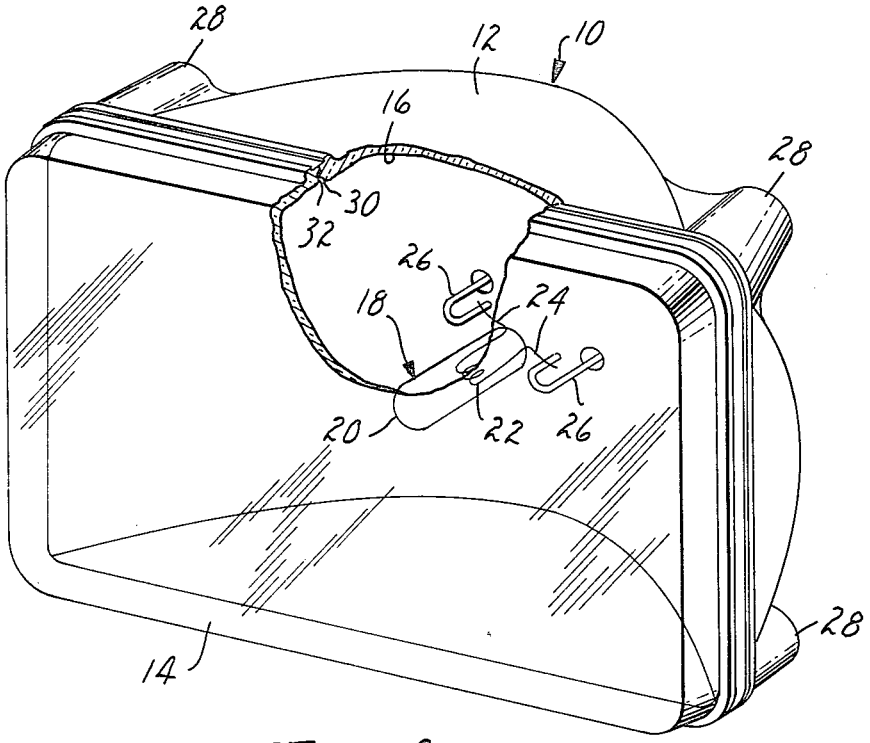
FIG. 1 is a perspective view of a preferred lighting element enclosure of the present invention with portions cut away and shown in section

Thus in FIG. 1 there is shown an enclosed lighting element assembly 10 which is useful, for example, as an automobile headlamp. In the embodiment depicted the assembly comprises a generally concave housing 12 and a cooperating transparent cover or lens 14 therefor.

Housing 12 is interiorly reflective, (i.e., having a concave reflective surface) there being a thin metal vapor deposited coating 16 (e.g. aluminum) therein. Also disposed within the housing is a lighting element or capsule 18 which comprises a transparent envelope 20 having therein a filament 22. Filament 22 is connected by leads 24 and 26 to the exterior backside of housing 12, there being hermetic seals around leads 24 where they exit envelope 20 and where leads 26 exit through the backside of housing 12. Leads 26 may in turn be connected to an external source of electrical energy such as an automobile alternator (not shown) which provides electrical energy to cause filament 22 to incandesce. "Lighting element" as the term is used herein is meant to include the light producing capsules shown herein, open filaments (i.e. metallic filaments without an envelope), and various bulbs which are optionally replaceable. The capsule 18 shown herein when manufactured from quartz and having therein an amount of a halogen gas, (e.g. bromine) is referred to in the art as a quartz-halogen capsule. The backside of housing 12 may be adapted to be fitted into the front portion of an automobile (such as by support means 28) to provide illumination therefor.

Figure 2:
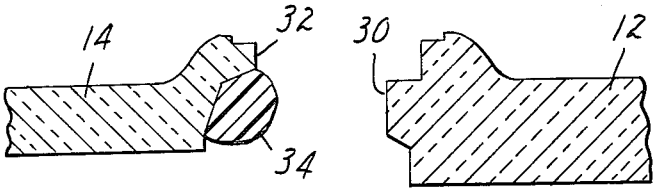
FIGS. 2 and 3 are partial cross-sectional views of the cooperating peripheral portions of the invention of FIG. 1 showing the placement of adhesive therebetween.

Around the periphery of housing 12 is a substantially male cooperating surface 30 which cooperates with a female surface 32 around the periphery of transparent cover 14. Cooperating surfaces 30 and 32 are adapted to form a joint therebetween when suitably affixed to each other. Conventionally, of course, cooperating surfaces 30 and 32 would be heat fused to each other. As more clearly seen in FIGS. 2 and 3, in a practice of this invention a quantity or bead 34 of actinic light curable sealant or adhesive is disposed along the entire length of either of cooperating surfaces 30 and 32 usually after cleaning the cooperating surfaces using a volatile solvent such as methylethyl ketone. Application techniques include syringes, manual or air-operated caulking guns or automated sealant application techniques. After the sealant has been disposed along either of the peripheries (to a coverage generally in the range of 0.01 to 0.3 grams sealant per lineal inch of periphery), the cooperating surfaces are mated so as to dispose the sealant/adhesive therebetween.

Figure 3:
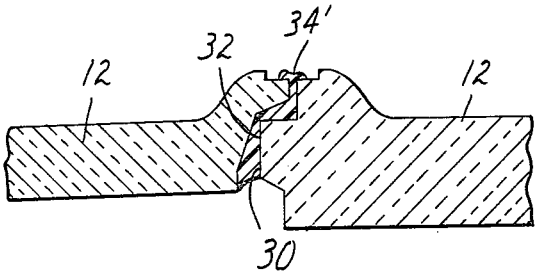

After the cooperating surfaces have been mated, cure of the sealant therebetween is initiated by exposing the sealant to actinic light. The sealant may be exposed to actinic light (e.g., for a period of 5 to 300 seconds) by directing an actinic light source, (e.g. a medium pressure mercury vapor lamp) through lens 14 (if the lens is appropriately transmissive to actinic light). Alternatively, actinic light may be focused laterally around the outside of the assembly coplanar with the sealant to expose the exteriorly disposed sealant to radiation. In either case the completed assembly will appear in cross-section substantially as shown in FIG. 3, with the cured adhesive 34' between the cooperating portions.

In a further practice of the present invention, a delayed curing epoxy-containing composition is employed. In this method, the delayed curing epoxy-containing composition is applied to one or the other or both of the cooperating portions and exposed to actinic light for a brief period of 0.02 to about 10 seconds. At this point, the cooperating portions are brought together and maintained in registration until the epoxy composition cures to form a seal. The time required for the delayed curing epoxy to completely cure is generally from 30 seconds to 24 hours. The use of the delayed curing epoxy-containing composition is particularly advantageous in those situations where actinic light absorptive substrates (e.g., metals and various polymers) are joined. As more completely described in applicant's above noted copending application, the polyoxyalkylene mono, di, or polyepoxides, such as polyoxypropylene diepoxide, are a particularly useful class of delayed curing epoxides especially when used in admixture with other epoxy-containing materials.

Figure 4:
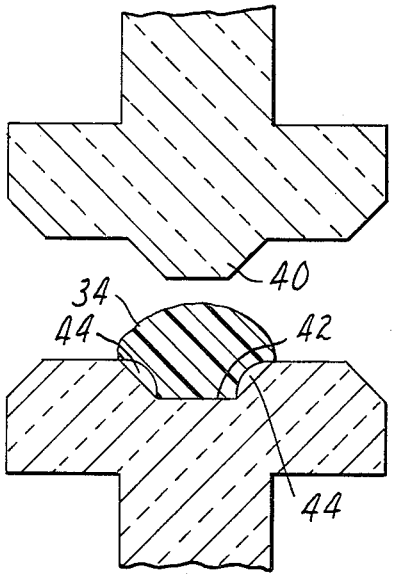
FIGS. 4 through 7 are further partial cross-sectional views of cooperating peripheral portions, such as may be employed in the present invention.
Figure 5:
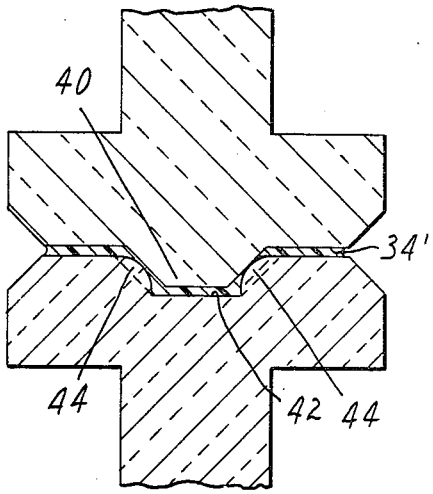
Figure 6:
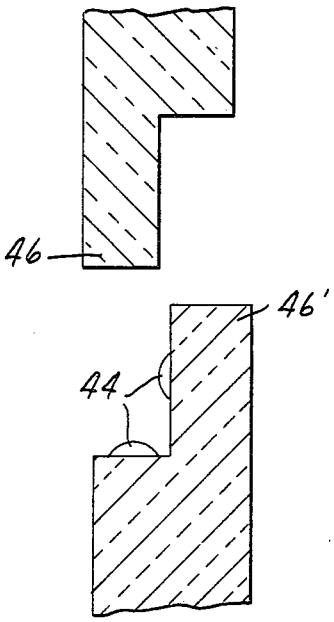
Figure 7:
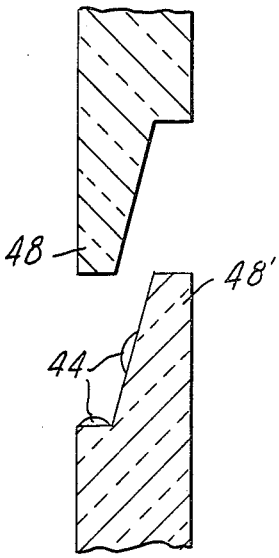

FIGS. 4, 5, 6 and 7 depict alternative configurations or designs for the cooperating surfaces of the cover or the housing. FIGS. 4 and 5 show a tongue 40 and groove 42 arrangement (uncured sealant 34 and cured sealant 34' being disposed therebetween) while FIGS. 6 and 7 show lapping sections 46, 46', 48 and 48' which overlap to form lap joints.

Of particular note in FIGS. 4 through 7 are protrusions or spacers 44 which have been molded into one or the other of the cooperating surfaces which form the joints. These spacers are molded into the material of the housing (or cover), there being from 6 to 10 generally hemispherical spacers evenly distributed around the perimeter formed by the cooperating surfaces. The spacers project above the adjacent surface from which they are molded to a height generally equal to the desired thickness of the sealant 34 which is to be disposed between the cooperating portions. A sealant thickness of about 0.010 inch (250 micrometers) is usually desirable and hence the height of the spacers is preferably about 0.010 inch (250 micrometers) with spacer height in the range of about 0.002 inch (50 micrometers) to 0.050 inch (1250 micrometers) being contemplated. The spacers serve to provide a uniform sealant thickness as well as reducing the difficulty of obtaining proper registration between housing and its cover. Proper registration and sealant thickness between the housing and its cover is obtained merely by pressing the housing and its cover together until the spacers engage the opposing cooperating surface.

The sealant which is preferred in the practice of the present invention is an actinic light curable epoxy composition having improved flexibility, the composition comprising in admixture:

a. epoxy-containing material;
b. vinyl-terminated acrylonitrile-butadiene polymer, and;
c. actinic-light-activatable epoxy cure initiator, the composition optionally including therein;
d. hydroxyl-containing organic material and
e. filler.

Preferably the composition used in this invention comprises: (a) 100 parts by weight epoxy-containing materials, (b) 5 to 200 parts by weight vinyl-terminated acrylonitrile-butadiene polymer, (c) 0.5 to 80 parts by weight actinic-light-activatable epoxy cure initiator, (d) 5 to 400 parts by weight of hydroxyl-containing organic material, (e) 0.5 to 100 parts by weight adhesion promoter and (f) 0.5 to 400 parts by weight filler.

It is especially important (where glass to glass bonds are being formed) that the sealants used herein include 0.5 to 100 parts by weight (based upon 100 parts by weight epoxy-containing material), preferably 5 to 50 parts by weight adhesion promoter. By "adhesion promoter" herein it is meant a material which has an affinity for both the substrate and the adhesive, sealant or coating being used. For example, conventional silane compounds such as beta-3,4-(epoxycyclohexyl)ethyltrimethoxy-silane, and gamma glycidoxypropyltrimethoxysilane, (both commercially available from Union Carbide Corporation under the trade designation "A-186" and "A-187" respectively) can be utilized as adhesion promoters where a glass-to-glass bond is intended. Other adhesion promoters or primers are well known to those skilled in the art.

The sealed lighting assemblies produced in the practice of the present invention are sufficiently integral so that they may be evacuated or pressurized. A dry inert gas such as dry air or nitrogen at atmospheric pressure may be introduced into the housing if substantially ambient pressure inside the housing is desired. In operation interior temperatures of the housing may reach 200° F. to 250° F. (90° C. to 120° C). These temperatures are easily withstood by the present assemblies, there being no significant adhesive degradation.

Objects and advantages of this invention are illustrated in the following examples which should not be construed to limit the scope of this invention. All parts are by weight unless otherwise specified.

EXAMPLE

Illustrating the preparation of an assembly of the invention.

A ½ pint (250 ml) epoxy-lined friction top metal container (a conventional paint container) metal container was charged with 71.8 g of cycloaliphatic epoxy "ERL 4221", 30 g of previously melted (heated to about 160° F., 70° C.) polytetramethyleneether glycol "Polymeg 1000", 10 g vinyl terminated acrylonitrile-butadiene polymer "Hycar 1300×23", 10 g gamma-glycidoxypropyltrimethoxy silane "A187" and 11.7 g of a 30% by weight solution of triarylsulfonium hexafluoroantimonate in "ERL 4221". The room temperature mixture was maintained under normal lighting conditions (i.e., in the absence of sunlight) and was stirred at low speed using an air driven 4 bladed impeller ("High Lift" 1.5 inch diameter impeller commercially available from M. F. Fawcett Company) until a uniform mixture was obtained, e.g., 5 min. Four grams of fumed silica ("Cab-O-Sil") was added to the admixture while increasing the impeller speed to ensure complete dispersal of the silica, thus completing the formulation of the composition. At this point the composition was degassed in a vacuum chamber by evacuating to a pressure of about 1 psi (6.9 kPa), this pressure being maintained for 30 minutes at which time no further dissolved gas evolved from the admixture (i.e., bubbling ceased). A dry nitrogen line was attached to an inlet to the vacuum chamber and the chamber was backfilled to atmospheric pressure. The composition then was removed from the vacuum chamber. The cooperating peripheral portions of an assembly depicted in FIG. 1 were cleaned using a clean dry cloth saturated with methylethyl ketone. The photocurable mixture was drawn into a disposable 3 cc syringe. The syringe was fitted with an 18 gauge by two inch hypodermic needle. Using the filled syringe and needle the photocurable mixture was applied to the cooperating portion of the housing of the headlamp assembly. The lens portion of the assembly was positioned over the peripherally coated housing, the cooperating portions of the housing and the cover being brought together with the photocurable composition therebetween. The composition spreads uniformly over (coats or wets) both cooperating portions to form a seal. The assembly then was irradiated by exposure to a 200 watt/inch mercury vapor lamp for a period of 30 seconds. Distance from the arc tube to headlamp lens was 5 inches. The arc tube was parallel to the long dimension of the headlamp and equidistant from the two long sides of the lens. Exposure was through the lens of the headlamp assembly.

Various modifications and alterations of the invention will become apparent to those skilled in the art without departing from the scope and spirit of the invention, and it should be understood that this invention is not to be limited to the illustrative embodiments and examples set forth herein.

What is claimed is:

1. A sealed lighting element assembly comprising a housing and a cover therefor, at least a portion of said housing or said cover being light transmissive, said housing or said cover being adapted to support a lighting element within said assembly, said housing and said cover having cooperating portions which are joined with an actinic light cured sealant derived from an admixture of epoxy-containing material and vinyl terminated acrylonitrile-butadiene polymer.

2. An assembly in accordance with claim 1 wherein said housing has a concave reflective surface and said cover is light transmissive.

3. An assembly according to claim 1 wherein said assembly is an automobile headlamp.

4. An assembly according to claim 1 wherein said cover and said housing are joined so as to form a hermetic seal.

5. An assembly in accordance with claim 1 wherein said cooperating portions comprise a tongue and groove joint.

6. An assembly in accordance with claim 1 wherein said cooperating portions comprise lap joints.

7. An assembly in accordance with claim 1 wherein said cooperating portions have a plurality of spacers therebetween.

8. An assembly according to claim 1 wherein said lighting element is a quartz-halogen capsule.

9. A sealed lighting element assembly comprising a housing and a cover therefor, said cover being light transmissive, said housing having a concave reflective inner surface and supporting therein a lighting element, said housing and said cover having cooperating peripheral portions with an actinic light cured sealant comprising epoxy-containing material and vinyl terminated acrylonitrile-butadiene polymer disposed therebetween, said cooperating peripheral portions and said sealant forming a hermetic seal.

10. An assembly according to claim 9 which comprises an automobile headlamp.

11. A method for enclosing a lighting element comprising the steps of:

(a) providing a housing and a cover therefor, at least a portion of said housing or said cover being light transmissive, said housing or said cover being adapted to support a lighting element within said enclosure so that said element may be electrically energized, said housing and said cover having cooperating portions which are adapted to be joined with an actinic light curable adhesive derived from an admixture of epoxy-containing material and vinyl terminated acrylonitrile-butadiene polymer;

(b) placing on one or both said cooperating portions a quantity of actinic light curable adhesive sufficient to form a seal between said housing and said cover when said sealant is cured;

(c) bonding said cover to said housing at said cooperation portions by curing said adhesive therebetween with actinic light.

12. A method according to claim 11 wherein said bonding step comprises bringing said housing and said cover together at said cooperating portions and curing said photocureable composition between said cooperating portions by exposure to actinic light.

13. A method according to claim 11 wherein said bonding step comprises exposing said composition to actinic light and bringing said housing and said cover together at said cooperating portions so as to form a seal therebetween.

14. A method according to claim 11 wherein said photocurable composition comprises in admixture 100 parts epoxy containing material;

5 to 200 parts vinyl terminated acrylonitrite-butadiene polymer 0.5 to 80 parts actinic light activatable epoxy cure initiator.

15. A method according to claim 14 wherein said photocureable composition further comprises 0.5 to 400 parts filler and 0.5 to 100 parts adhesion promoter.

16. A method according to claim 15 wherein said photocurable composition further comprises a sensitizer.

17. A lighting element assembly comprising a housing and a cover therefor, at least a portion of said housing or said cover being adapted to support a lighting element within said assembly, said housing and said cover having male and female portions which cooperate to form a seal, there being disposed around said portions a plurality of spacers.

18. An assembly according to claim 17 wherein said spacers are hemispherical, are molded into one or the other of said portions and have a height in the range of about 0.002 inch (50 micrometers) to 0.050 inch (1250 micrometers).

* * * * *